US009281589B2

(12) United States Patent
Hsiao et al.

(10) Patent No.: US 9,281,589 B2
(45) Date of Patent: Mar. 8, 2016

(54) ELECTRICAL CONNECTOR HAVING BETTER HIGH-FREQUENCY PERFORMANCE

(71) Applicant: FOXCONN INTERCONNECT TECHNOLOGY LIMITED, Grand Cayman (KY)

(72) Inventors: Yu-San Hsiao, New Taipei (TW); Yu Zhu, Shenzhen (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/594,056

(22) Filed: Jan. 9, 2015

(65) Prior Publication Data

US 2015/0200503 A1 Jul. 16, 2015

(30) Foreign Application Priority Data

Jan. 14, 2014 (CN) ..... 2014 2 0020431 U

(51) Int. Cl.

| | |
|---|---|
| ***H01R 24/00*** | (2011.01) |
| ***H01R 12/71*** | (2011.01) |
| ***H01R 4/04*** | (2006.01) |
| *H01R 13/655* | (2006.01) |
| *H01R 31/08* | (2006.01) |

(52) U.S. Cl.

CPC ..... *H01R 12/716* (2013.01); *H01R 4/04* (2013.01); *H01R 13/655* (2013.01); *H01R 31/08* (2013.01)

(58) Field of Classification Search

CPC ..... H01R 12/716; H01R 4/04; H01R 13/655; H01R 31/08; H01R 13/6471; H01R 13/6598; H01R 13/6477; H01R 13/65807

USPC ..... 439/676

See application file for complete search history.

(56) References Cited

U.S. PATENT DOCUMENTS

| | | | | |
|---|---|---|---|---|
| 7,828,597 | B1 * | 11/2010 | Jin | H01R 13/65807 439/607.05 |
| 2005/0059296 | A1 * | 3/2005 | Wang | H01R 13/6477 439/541.5 |
| 2013/0130548 | A1 * | 5/2013 | Wu | H01R 13/6598 439/607.01 |
| 2015/0038013 | A1 * | 2/2015 | Shiratori | H01R 13/6471 439/607.11 |

FOREIGN PATENT DOCUMENTS

| | | |
|---|---|---|
| CN | 202585857 U | 12/2012 |
| TW | M454014 | 5/2013 |

* cited by examiner

*Primary Examiner* — Jean F Duverne

(74) *Attorney, Agent, or Firm* — Wei Te Chung; Ming Chieh Chang

(57) ABSTRACT

An electrical connector includes an insulative housing and a plurality of conductive terminals fixed in the insulative housing. The conductive terminals includes a first terminal group, the first terminal group includes a plurality of signal terminals and a plurality of grounding terminals. The insulative housing defines a cured conductive adhesive, the cured conductive adhesive makes the grounding terminals of the first terminal group shorted to each other.

10 Claims, 4 Drawing Sheets

ELECTRICAL CONNECTOR HAVING BETTER HIGH-FREQUENCY PERFORMANCE

BACKGROUND OF THE INVENTION

1. Field of the Invention

The present invention relates to an electrical connector, and more particularly to an electrical connector having better stability and high-frequency performance.

2. Description of the Related Art

China Utility Pat. No. 202585857U issued on Dec. 5, 2012, discloses a high-speed connector including an insulative housing, a plurality of conductive terminals and at least two conductive plastic blocks. The insulative housing defines a tongue portion and at least one recesses on the tongue portion. The conductive terminals include a first signal terminal group, a second signal terminal group located on the tongue portion and a power terminal group which respectively defines a plurality of positive electrode terminals and a plurality of negative electrode terminals, and each conductive terminal defines a contacting portion. Wherein the contacting portions of the first signal terminal group are fixed in the corresponding recesses and form a plurality of gaps with the bottom surface of the recesses, the conductive plastic blocks are connected to the contacting portions of the negative electrode terminals of the first and second signal terminal groups. In this way, it can increase the contact area between the contacting portion and air in order to improve the electrical performance and enhance the transmission rate. At the same time it can reduce the interference between the signals by the shielding characteristics of the conductive plastic blocks so that the connector can have a faster transmission rate. However, there is loosening phenomenon between the conductive plastic block and the insulative housing during practical use.

Therefore, an improved electrical connector is highly desired to meet overcome the requirement.

BRIEF SUMMARY OF THE INVENTION

An object of the present invention is to provide an electrical connector with an insulative housing having better stability and high-frequency performance.

In order to achieve above-mentioned object, an electrical connector includes an insulative housing and a plurality of conductive terminals fixed in the insulative housing. The conductive terminals includes a first terminal group, the first terminal group includes a plurality of signal terminals and a plurality of grounding terminals. The insulative housing defines a cured conductive adhesive, the cured conductive adhesive makes the grounding terminals of the first terminal group shorted to each other.

Other objects, advantages and novel features of the invention will become more apparent from the following detailed description of the present embodiment when taken in conjunction with the accompanying drawings.

DESCRIPTION OF PREFERRED EMBODIMENT OF THE INVENTION

Figure 1:
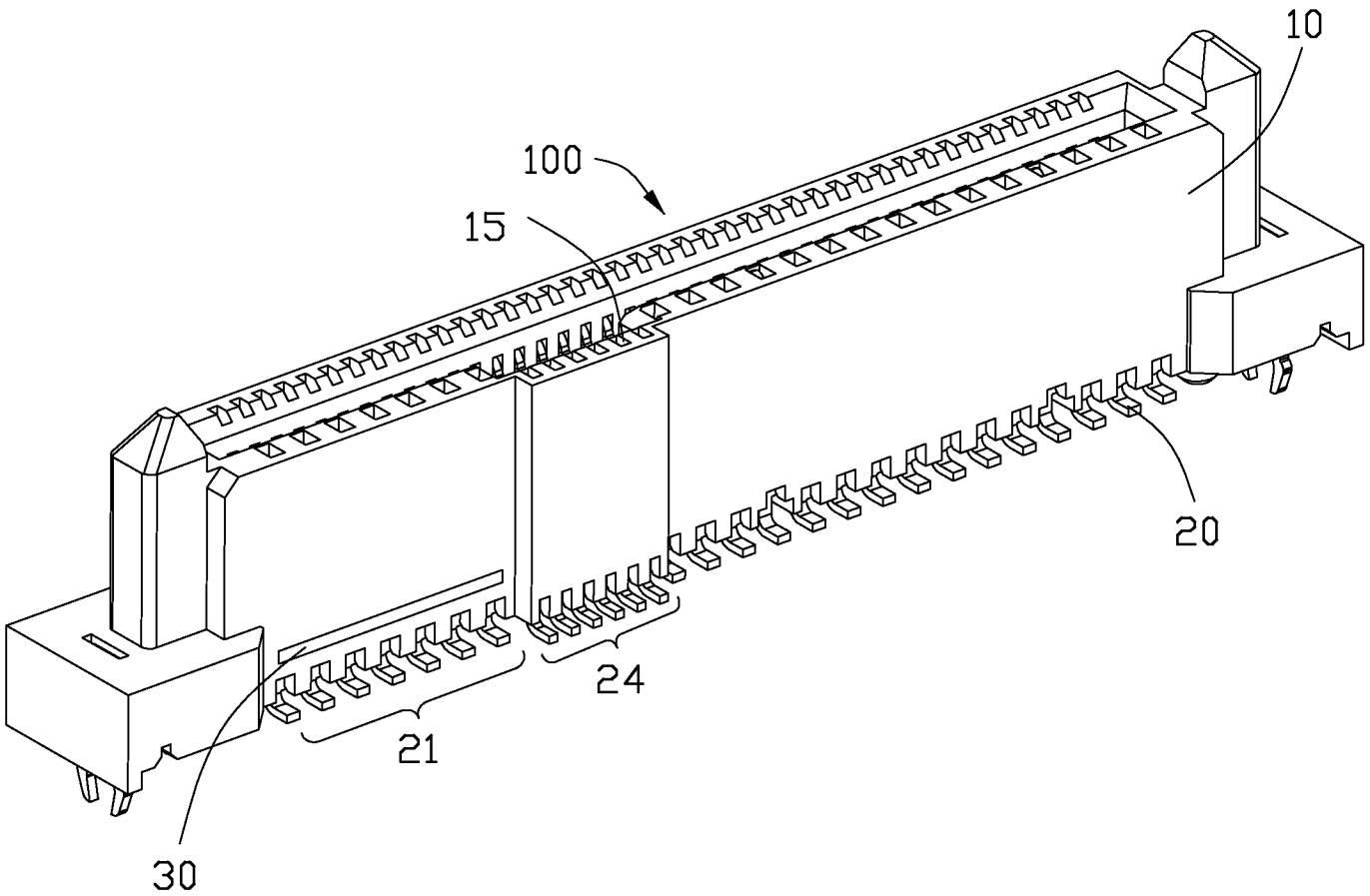
FIG. 1 is a perspective view showing an electrical connector in accordance with the present invention.
Figure 2:
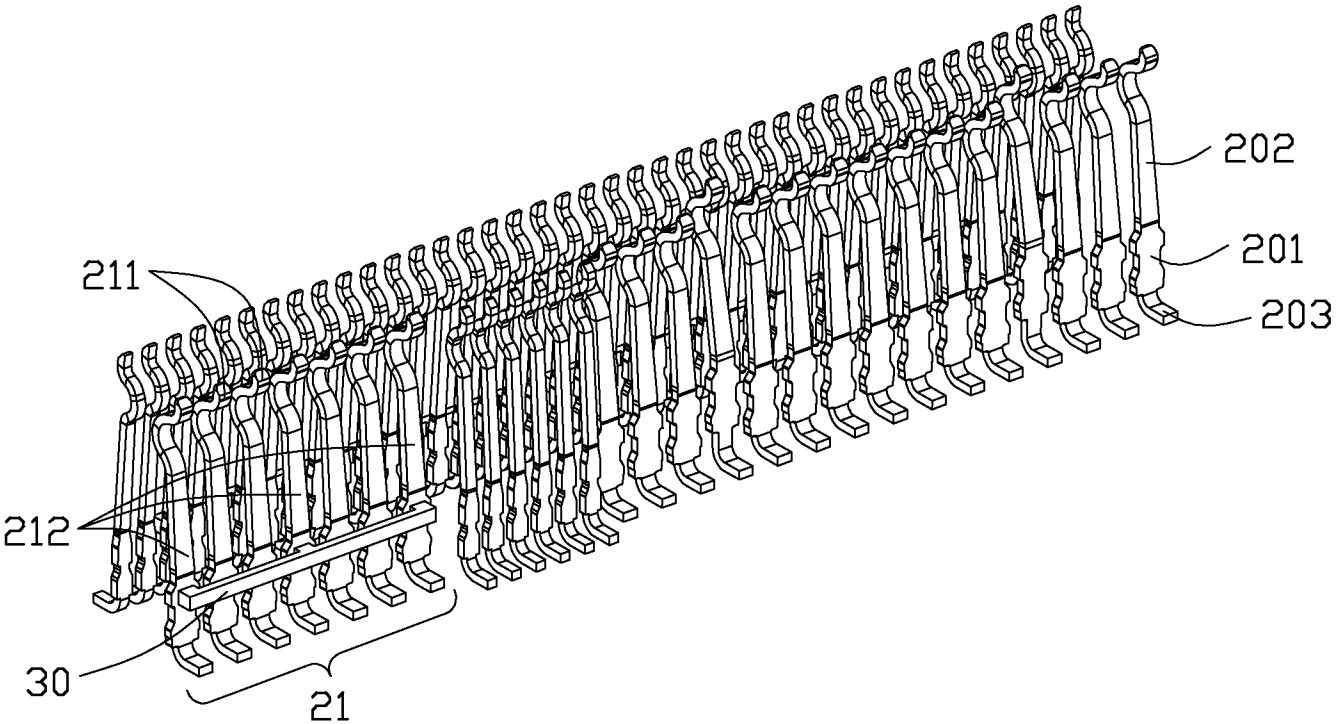
FIG. 2 is a perspective view of the electrical connector without an insulative housing shown in FIG. 1.
Figure 3:
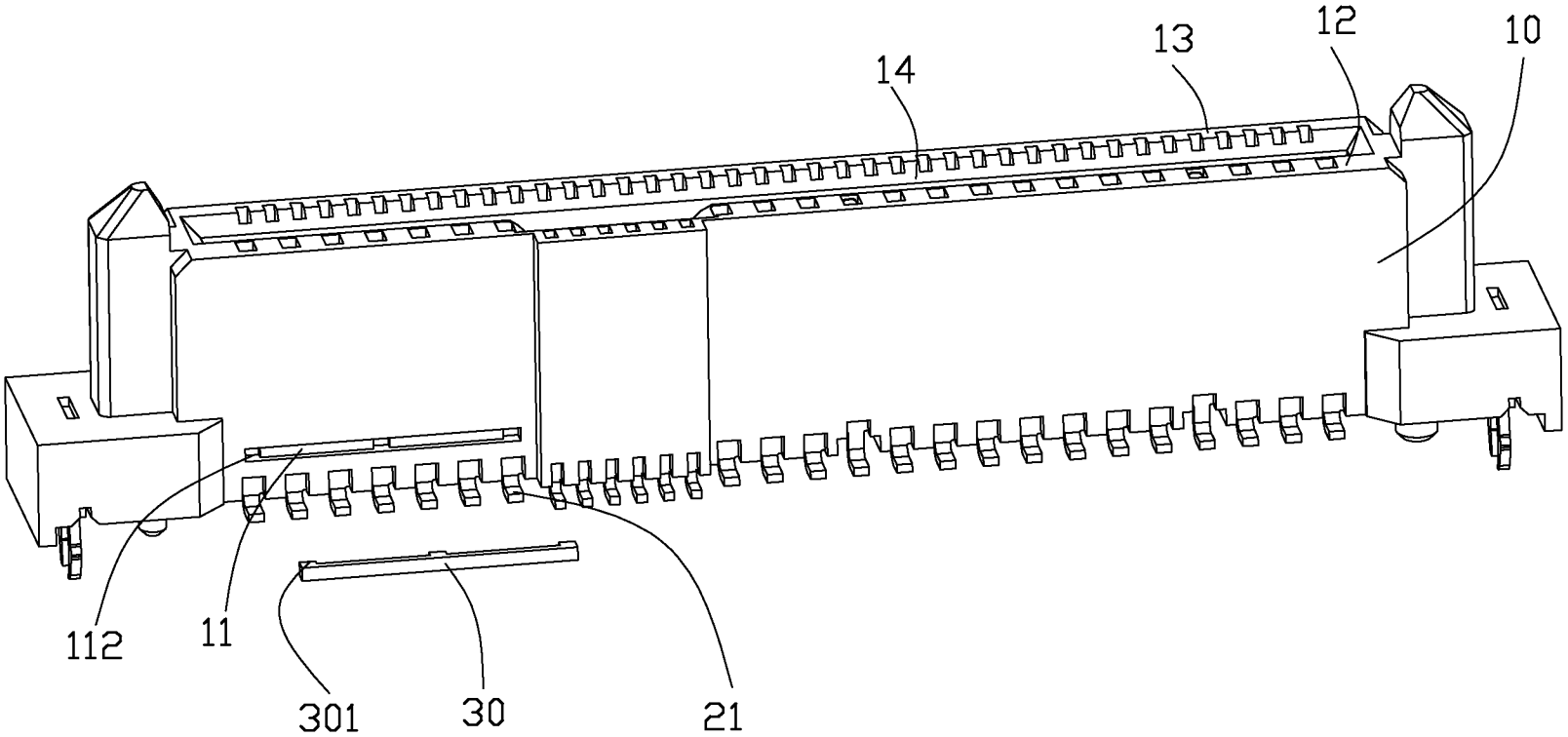
FIG. 3 is a partially exploded perspective view of the electrical connector shown in FIG. 1, wherein a cured conductive glue is separated from the insulative housing of the electrical connector.

Reference will now be made to the drawing figures to describe a preferred embodiment of the present invention in detail. Referring to FIG. 1 to FIG. 3, an electrical connector 100 is used to transmit high-frequency signals and may be a board connector or a cable connector. The electrical connector 100 includes an insulative housing 10 and a plurality of conductive terminals 20 retained in the insulative housing 10, the conductive terminals 20 includes a first terminal group 21 and the first terminal group 21 defines a plurality of signal terminals 211 and a plurality of grounding terminals 212. The insulative housing 10 defines a cured conductive adhesive 30 which makes the grounding terminals 212 of the first terminal group shorted to each other in order to achieve shorten the electrical length and improved the high-frequency transmission performance. The insulative housing 10 also defines a receiving slot 11, the conductive adhesive is injected into the receiving slot 11 and cured. A molten liquid conductive adhesive is injected into the insulative housing and integrally molded with the insulative housing by curing in order to ensure the insulative housing has a better stability.

Figure 4:
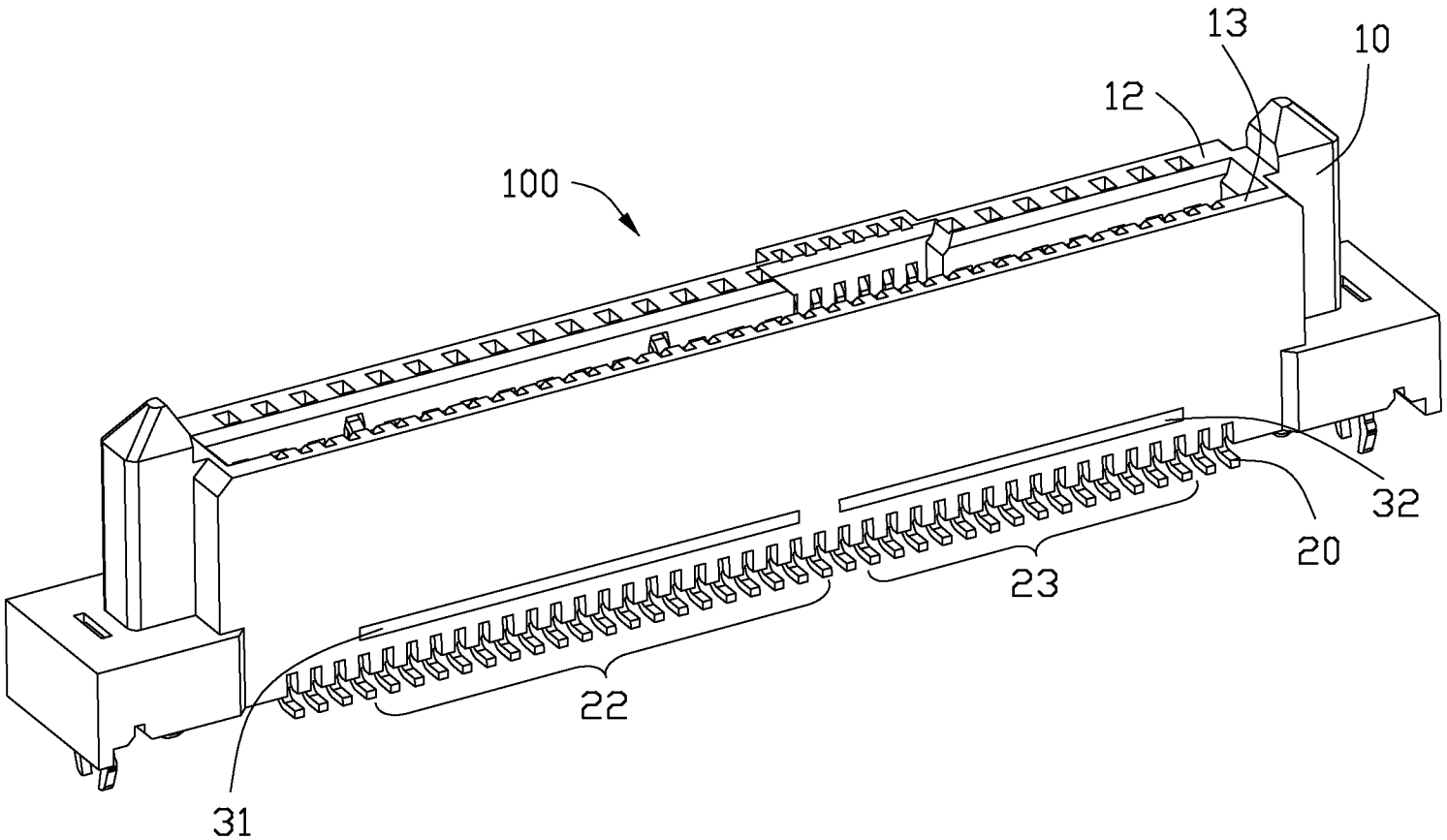
FIG. 4 is another perspective view of the electrical connector shown in FIG. 1.

The insulative housing 10 defines a first sidewall 12, a second sidewall 13 parallel to the first sidewall and an engaging cavity 14 formed between the first sidewall 12 and the second sidewall 13, the first sidewall 12 defining a set of grooves communicating with the engaging cavity 14 and the first terminal group 21 is fixed in the first sidewall 12. Combined with FIG. 4, the conductive terminals also include a second terminal group 22 and a third terminal group 23 fixed in the second sidewall 13, the second terminal group 22 includes a plurality of signal terminals and a plurality of grounding terminals, the grounding terminals of the second terminal group are shorted to each other by another cured conductive adhesive 31. The third terminal group 23 includes a plurality of signal terminals and a plurality of grounding terminals, the grounding terminals of the third terminal group are shorted to each other by another cured conductive adhesive 32, due to the structure of the conductive terminal of the second and third terminal groups is similar to the structure of the conductive terminals of the first terminal group, the specific configuration of the conductive terminals will not be described in detail.

Referring to FIG. 2, each conductive terminal 20 defines a retaining portion 201 retained in the groove, an elastic contacting portion 202 extending from the retaining portion 201 and protruding into the engaging cavity 14 and a soldering portion 203 extending outside of the insulative housing 10, the cured conductive adhesives 30-32 contact with the retaining portions 201 of the conductive terminals, in particular the retaining portion has a horizontal shape, and stably fixed in the first and second sidewalls of the insulative housing 10. In the process, it should only open a through-hole and make the conductive glue injected therein in order to avoid the cured conductive adhesive shift.

The first sidewall 13 defines a plurality of through-holes 112 corresponding to the grounding terminals 212 of the first terminal group, the receiving slot 11 is connected to the through-holes 112 and only through an outer surface of the first sidewall 12, the cured conductive adhesive 30 is fixed in the through-holes 112 and the receiving slot 11. In the injection molding process of the insulative housing, the formed of the receiving slot and the through-holes become very simple, the receiving slot is not communicating with the soldering portion of the conductive terminals, which ensure that conductive glue will not spread to other parts of the insulative housing and avoid unnecessary short. The cured conductive adhesive 30 is a rod-shaped and has a plurality of projections 301 corresponding to the grounding terminals of the first terminal group 21. The cured conductive adhesives corresponding to the second and third terminal groups are similar to the cured conductive adhesive corresponding to the first sidewall, the specific configuration of cured conductive adhesive will not be described in detail. The first sidewall 12 defines a plurality of recesses 15 in the inner surface thereof and there are a forth terminal group 24 fixed in the corresponding recesses 15.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. An electrical connector, comprising:

an insulative housing;

a plurality of conductive terminals fixed in the insulative housing and including a first terminal group, the first terminal group including a plurality of signal terminals and a plurality of grounding terminals; wherein the insulative housing is equipped with a cured conductive adhesive, and the cured conductive adhesive makes the grounding terminals of the first terminal group shorted to each other; wherein the insulative housing defines a first sidewall and the first terminal group is fixed in the first sidewall, the first sidewall defines a receiving slot and a plurality of through-holes corresponding to the grounding terminals of the first terminal group and connecting to the receiving slot, the cured conductive adhesive is fixed in the through-holes and the receiving slot; wherein the insulative housing defines a second sidewall parallel to the first sidewall and an engaging cavity formed between the first sidewall and the second sidewall, the conductive terminals include a second terminal group fixed in the second sidewall, the second terminal group includes a plurality of signal terminals and a plurality of grounding terminals, the grounding terminals of the second terminal group are shorted to each other by another cured conductive adhesive; wherein the conductive terminals also include a third terminal group fixed in the second sidewall, the third terminal group includes a plurality of signal terminals and a plurality of grounding terminals, the grounding terminals of the third terminal group are shorted to each other by another cured conductive adhesive.

2. The electrical connector as described in claim 1, wherein the cured conductive adhesive is a rod-shaped and has a plurality of projections corresponding to the grounding terminals of the first terminal group.

3. The electrical connector as described in claim 1, wherein the receiving slot is only through an outer surface of the first sidewall.

4. The electrical connector as described in claim 1, wherein each conductive terminal defines a retaining portion, an elastic contacting portion extending from the retaining portion and a soldering portion extending outside of the insulative housing, the cured conductive adhesives contact with the retaining portions of the grounding terminals.

5. The electrical connector as described in claim 1, wherein the first sidewall defines a plurality of recesses in the inner surface thereof and there are a forth terminal group fixed in the corresponding recesses.

6. An electrical connector, comprising:

an insulative housing defining a pair of opposite first and second sidewalls, and an engaging cavity formed between the first and second sidewalls, the first sidewall defining a set of grooves communicating with the engaging cavity;

a plurality of conductive terminals including at least a first terminal group retained in the grooves of the first side wall and protruding into the engaging cavity, the first terminal group including a plurality of signal terminals and a plurality of grounding terminals; wherein the first sidewall has a receiving slot recessed from an outer surface thereof, and a plurality of through-holes connecting the receiving slot and the respective grooves to expose the respective grounding terminals outside;

the electrical connector further comprises a conductive adhesive being injected into the receiving slot and the through-holes so as to adhere to and electrically connect to the grounding terminals of the first terminal group; wherein each of the conductive terminal defines a retaining portion retained in the groove, an elastic contacting portion extending from the retaining portion and protruding into the engaging cavity, and a soldering portion extending outside of the insulative housing, the conductive adhesive adhere to the retaining portions of the grounding terminals.

7. The electrical connector as described in claim 6, wherein the conductive adhesive is cured in the receiving slot and the through-holes, and forms a horizontal connecting portion accommodated in the receiving slot and a plurality of projections entering into the respective through-holes.

8. An electrical connector comprising:

an insulative housing having a pair of spaced side walls extending along a longitudinal direction and defining therebetween an engaging cavity facing toward an exterior in a vertical direction perpendicular to said longitudinal direction;

a plurality of contacts disposed in the housing with contacting sections extending into the engaging cavity in a transverse direction perpendicular to said longitudinal direction and said vertical direction;

a receiving slot formed in one of said side walls and extending at least along said longitudinal direction and across some of said contacts, said receiving slot communicating with not only the exterior but also more than one of said some contacts via corresponding through holes each extending along the transverse direction; and a conductive adhesive filled within the receiving slot and the through holes;

wherein the adhesive in a liquid type is injected into the receiving slot via the exterior in said transverse direction and is solidified successively to be secured to the housing and to the corresponding contacts; wherein each of said contacts includes a surface mounting tail, and the adhesive is located aligned with and above the surface mounting tails of the corresponding contacts; wherein the adhesive is located close to a bottom surface of the housing and the surface mounting tails of the corresponding contacts in the vertical direction.

9. The electrical connector as claimed in claim 8, wherein an outer surface of the adhesive is coplanar with an exterior surface of the corresponding side wall.

10. The electrical connector as claimed in claim 8, wherein each of said contacts forms a retention section, and the adhesive contacts the retention sections of the corresponding contacts.

* * * * *